United States Patent [19]

Taguchi et al.

[11] Patent Number: 4,777,159

[45] Date of Patent: Oct. 11, 1988

[54] DYE TRANSFER TYPE THERMAL PRINTING SHEETS AND METHOD FOR PRINTING

[75] Inventors: Nobuyoshi Taguchi; Akihiro Imai, both of Ikoma; Toshio Niwa, Yokohama; Yukichi Murata, Sagamihara, all of Japan

[73] Assignees: Matsushita Electric Industrial Co., Ltd., Osaka; Mitsubishi Chemical Industries Limited, Tokyo, both of Japan

[21] Appl. No.: 729,038

[22] Filed: Apr. 30, 1985

Related U.S. Application Data

[63] Continuation-in-part of Ser. No. 727,082, Apr. 25, 1985, abandoned.

[30] Foreign Application Priority Data

Apr. 27, 1984 [JP] Japan ..... 59-86539

[51] Int. Cl.[4] ..... B41M 5/26

[52] U.S. Cl. ..... 503/227; 8/471; 427/146; 427/256; 428/144; 428/195; 428/323; 428/913; 428/914; 430/945; 503/207

[58] Field of Search ..... 8/470, 471; 427/146, 427/256; 428/144, 195, 323, 913, 914; 430/945; 503/207, 227

[56] References Cited

U.S. PATENT DOCUMENTS

| | | | |
|---|---|---|---|
| 4,032,691 | 5/1977 | Kido et al. | 346/227 |
| 4,541,830 | 9/1985 | Hotta et al. | 8/471 |
| 4,614,521 | 9/1986 | Niwa et al. | 8/471 |

OTHER PUBLICATIONS

Patents Abstracts of Japan, vol. 8, No. 189, (M-321) (1626) Aug. 30th, 1984 & JP-A-59 78 894 (Mitsubishi Kasei Kogyo K.K.) 7/5/84 & JP-A-59 78 895 (Mitsubishi Kasei Kogyo K.K.) 7/5/84 & JP-A-59 78 896 (Mitsubishi Kasei Kogyo K.K.) 7/5/84.

Patents Abstracts of Japan, vol. 9, No. 103 (M-377) (1826), May 8th, 1985; & JP-A-59 227 493 (Mitsubishi Kasei Kogyo K.K.) 12/20/84.

Patents Abstracts of Japan, vol. 9, No. 316 (M-438) (2039) Dec. 12th, 1985; & JP-A-60 151 098 (Mitsubishi Kasei Kogyo K.K.) 8/8/85.

Patents Abstracts of Japan, vol. 10, No. 109 (M-472) (2166), Apr. 23rd, 1986; & JP-A-60 239 290 (Mitsubishi Kasei Kogyo K.K.) 11/28/85.

Patents Abstracts of Japan, vol. 10, No. 92 (M-468) (2149), Apr. 9th, 1986; & JP-1-60 229 791, (Matsushita Denki Sangyo K.K.) 11/15/85 & JP-A-60 229 788 (Matsushita Denki Sangyo K.K.) 11/15/85.

(List continued on next page.)

*Primary Examiner*—Bruce H. Hess

*Attorney, Agent, or Firm*—Stevens, Davis, Miller & Mosher

[57] ABSTRACT

The dye transfer type thermal printing sheet and method for printing of this invention are a printing sheet comprising a transfer sheet in which a smooth heat-resistant layer composed of fine particles, a liquid lubricating material and a polymer is formed on one side of a substrate, and on the other side is formed a coloring material layer containing at least one sublimable dye, non-sublimable particles and a binder, a part of said non-sublimable particles jutting out from the reference surface of the sublimable dye layer; and an image-receiving sheet having, on a substrate for image-receiving sheet, a development layer composed of, at least, inorganic fine particles; a binder having dye-affinity and another binder immiscible with said binder; and a dye transfer type thermal method for printing which comprises placing the aforesaid coloring material layer and development layer of the above-mentioned printing sheet face to face with each other, heating the printing sheet selectively from the smooth heat-resistant layer side of the transfer sheet, and thereby forming an image on the image-receiving sheet. By the above-mentioned sheet and method, there can given stable running of transfer sheet and a printed image which is reduced in dropout and noise, has a good depth of color and a good quality of image, and is excellent in storage stability. Further, a full-color image also can be obtained by using three kinds of transfer sheets which develop a cyan color, a magenta color or a yellow color, respectively.

16 Claims, 5 Drawing Sheets

OTHER PUBLICATIONS

EP-A-O 109 295 (Matsushita Electric Industrial Co. Ltd.) *Claims: p. 5, lines 3-14; p. 8, line 16-p. 10, line 6; Example 1, p. 14-Example 6, p. 25.

Patents Abstracts of Japan, vol. 10, No. 92 (M-468) (2149), Apr. 9th, 1986; & JP-A-60 229 790 (Matsushita Denki Sangyo K.K.) 11/15/85, & JP-A-60 229 789 (Matsushita Denki Sangyo K.K.) 11/15/85, & JP-A-60 793 (Mastushita Denki Sangyo K.K.) 11/15/85, & JP-A-60 795 (Matsushita Denki Sangyo K.K.) 11/15/85, & JP-A-60 225 797 (Matsushita Denki Sangyo K.K.) 11/11/85.

Patents Abstracts of Japan, vol. 8, No. 262 (M-341) (1699), Nov. 30th, 1984, & JP A 59 133 098 (Matsushita Denki Sangyo K.K.) 7/31/84.

Patents Abstracts of Japan, vol. 8, No. 258 (M-340) (1695), Nov. 27th, 1984; & JP-A-59 131 495 9 Matsushita Denki Sangyo K.K.) 7/28/84.

DYE TRANSFER TYPE THERMAL PRINTING SHEETS AND METHOD FOR PRINTING

The application is a continuation-in-part of Ser. No. 727,082, filed Apr. 25, 1985 now abandoned.

BACKGROUND OF THE INVENTION

As transfer sheets used in printing methods of this kind, there have heretofore been used those which are made of polyester fiber excellent in stability and contain a dye for transfer and textile printing, but since the sublimation property of the dye contained is insufficient, the transfer sheets of this kind are poor in tinting strength, so that it has been difficult to attain a sufficient depth of color by means of heat energy supplied from a conventional thermal head.

Although ion-type dyes containing a color former rich in sublimation property can give a sufficient depth of color, the storage stability of a printed image on the printing sheet obtained by using these dyes have been insufficient.

On the other hand, the printed image produced by these dyes has a disadvantage of unevenness of its quality particularly in the region of intermediate color tone, and the main causes of this disadvantage have been dropout of printing in portions to which energy is applied and sublimation or spattering (noise) of the dye in portions to which no energy is applied.

Further, particularly when a thermal head is used as a means of printing, substrates for transfer sheet made of an inexpensive and homogeneous film which are used for obtaining a homogeneous image is, in some cases, fused together with the thermal head by an intense heat generated by the thermal head, so that their stable running on the thermal head has been difficult.

On the other hand, as an image-receiving sheet in which an image is formed by selectively heating a dye on the transfer sheet according to signals of the image, there is used one which comprises paper made from pulse and having an uneven thickness as a substrate for image-receiving sheet and a development layer formed thereon which is composed of inorganic fine particles and a binder having dye-affinity such as polyester. Therefore, the printed image obtained has no smooth quality in the region of intermediate color tone, and no image having a high printing density can be obtained. Moreover, the printed image obtained is poor in stabilith, for example, light resistance.

SUMMARY OF THE INVENTION

This invention relates to a method for printing by thermal dye transfer, particularly a dye transfer type thermal method for printing applied to electronic recording by an electronic device such as a thermal head, a laser beam or the like, and, in particular, aims at providing dye transfer type thermal printing sheets and method for printing which give a good quality of printed image by attaining a sufficient depth of color by use of a dye which is stable and excellent in subliming ability, reducing the dropout and noise in the region of intermediate color tone, and running the printing sheet stably on a thermal head.

The basic structure of the dye transfer type thermal printing sheet of this invention comprises a transfer sheet and an image-receiving sheet. In the dye transfer sheet, a smooth heat-resistant layer is formed on one side of a substrate and a coloring material layer containing a sublimable dye on the other side. The image-receiving sheet has a structure in which a development layer is formed on its substrate. The printing method of this invention comprises placing the coloring material layer and the development layer face to face with each other, heating the resulting assembly selectively from the smooth heat-resistant layer side of the transfer sheet, and thereby forming an image on the image-receiving sheet.

DETAILED DESCRIPTION OF THE INVENTION

Figure 1:
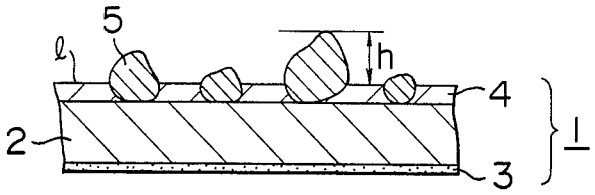
FIG. 1 is a longitudinal section for a transfer sheet of one example of this invention.

In this invention, there is used a printing sheet comprising a transfer sheet in which a smooth heat-resistant layer composed of fine particles, a liquid lubricating material and a polymer is formed on one side of a substrate, and on the other side is formed a coloring material layer containing at least one member selected from the group consisting of sublimable dyes of the general formulae (I), (II) and (III):

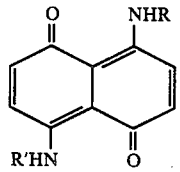

(I)

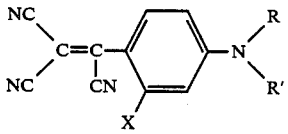

(II)

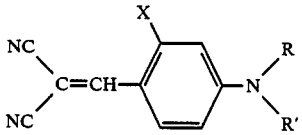

(III)

(wherein X is a hydrogen atom or a methyl group, and each of R and R' is a methyl group, an ethyl group, or a straight-chain or branched-chain propyl or butyl group), non-sublimable particles and a binder, a part of said non-sublimable particles jutting out from the reference surface of the sublimable dye layer; and an image-receiving sheet having, on a substrate for image-receiving sheet, a development layer composed of inorganic fine particles, a binder having dye-affinity, and another binder immiscible with said binder. The aforesaid coloring material layer and the development layer are placed face to face with each other, and the resulting assembly is heated selectively from the smooth heat-resistant layer side of the transfer sheet, whereby an image is formed on the image-receiving sheet.

Embodiments of this invention are explained below.

The basic constitution of this invention is a printing sheet comprising a transfer sheet in which a smooth heat-resistant layer composed of fine particles, a liquid lubricating material and a polymer is formed on one side of a substrate, and on the other side is formed a coloring material layer containing at least one member selected from the group consisting of sublimable dyes of the above general formulae (I), (II) and (III), non-sublimable particles and a binder, a part of said non-sublimable particles jutting out from the reference surface of the sublimable dye layer. Further, it relates to a dye transfer type thermal method for printing which comprises placing the aforesaid coloring material layer and the development layer face to face with each other, heating the resulting assembly selectively from the smooth heat-resistant layer side, and thereby forming an image on the image-receiving sheet.

As structure examples of the transfer sheet, there are the followings.

A structure in which three coloring material layers different in hue, each containing at least one sublimable dye selected from the group consisting of sublimable dyes of the general formulae (I), (II) and (III), are placed on the substrate in sequence so as to join their surfaces together.

A structure in which the coloring material layer contains two or more sublimable dyes different in their substituents among the dyes of the general formulae (I), (II) and (III).

A structure in which three coloring material layers, each containing at least one member selected from the group consisting of sublimable dyes represented by the general formulae (I), (II) and (III), and a fourth coloring material layer containing sublimable dyes selected, at least one for each formula, from the group consisting of sublimable dyes of the general formulae (I), (II) and (III) are placed in sequence so as to join their surfaces together.

A structure in which any point in the range bounded by circles with a radius of 200 μm and with their centers at each point on the circumference of a section of any non-sublimable particle along the reference surface of the sublimable dye layer, is occupied by another non-sublimable particle.

A structure in which the height of any non-sublimable particle from the reference surface of the sublimable dye layer ranges from 0.1 to 100 μm.

A structure in which the particle size of the non-sublimable particles ranges from 0.1 to 100 μm.

A structure in which the non-sublimable dye is present in the binder or in the surface or the interior of the non-sublimable particles.

A structure in which three or more non-sublimable particles are provided in optional points corresponding to picture elements.

A structure in which the average particles size of the fine particles contained in the smooth heat-resistant layer is 6 μm or less.

A structure in which the surface of the smooth heat-resistant layer is roughened by using, as the fine particles, carbon black, white carbon, hydrophobic silica and ultrafine particles of silicic anhydride.

A structure in which any of a curable resin, a light-curable resin and a cured product of oligoacrylate is used as the polymer.

Next, examples of the structure of the image-receiving sheet are described below.

A structure in which the binder immiscible with the binder having dye-affinity in the development larger is selected from the group consisting of hydrocarbon resins, fluorine-contained resins and silicone resins.

A structure in which the inorganic fine particles have a particle size of 500 Å or less.

A structure in which the inorganic fine particles are acidic.

A structure in which at least one member selected from the group consisting of finely powdered oxides and latexes is contained between the development layer and the substrate for image-receiving sheet.

A structure in which the substrate for image-receiving sheet has a layer comprising at least a polymer.

An image of high quality can be obtained by holding the transfer and image-receiving sheets having any of the above-mentioned structures between a printing means such as a thermal head or the like and a platen, placing the coloring material layer and the development layer face to face with each other, and heating the resulting assembly selectively from the smooth heat-resistant layer side. The smooth heat-resistant layer contacted with the thermal printing means such as a thermal head or the like of the transfer substrate is improved in heat resistance by the heat-resistant resin, and its surface is roughened by the fine particles, so that a slight amount of the liquid lubricating material flows out from the interior of the smooth heat-resistant layer, therefore said heat-resistant layer can impart a stable running property to the substrate for transfer sheet. By virtue of the presence of the non-sublimable particles in the coloring material layer which play the role of a spacer, the dye surface and the image-receiving sheet surface on which an image is to be printed do not receive a pressing pressure higher than is needed, and hence noise in the range of intermediate color tonen can be reduced. Thus, by using a smooth heat-resistant layer and a coloring material layer containing non-sublimable particles and at least one dye of the above chemical structure which is excellent in subliming ability, hue and stability, both formed on a homogeneous substrate for transfer sheet such as a film or the like, and also using homogeneous substrate for image-receiving sheet with a uniform thickness and a development layer formed thereon which has any of the above-mentioned structures, the dye-adsorbing ability is improved, so that a good hue and a high printing density can be attained, and moreover an image excellent in stability such as light resistance and the like can be obtained. By employing a method having such a constitution, there can be obtained, by a stable printing method, a stable image which shows only slight noise or dropout in the range of intermediate color tone, is good in printing density and hue, and is substantially equal to silver salt photography.

Concrete examples of the sublimable dyes of the above general formulae (I), (II) and (III) are as follows: Sublimable dyes of the general formula (I) having a cyan color:

1,5-bis(methylamino)-4,8-naphthoquinone, 1,5-bis(ethylamino)-4,8-naphthoquinone, 1,5-bis(n-propylamino)-4,8-naphthoquinone, 1,5-bis(iso-propylamino)-4,8-naphthoquinone, 1,5-bis(n-butylamino)-4,8-naphthoquinone, 1,5-bis(iso-butylamino)-4,8-naphthoquinone, 1-methylamino-5-ethylamino-4,8-naphthoquinone, 1-methylamino-5-n-propylamino-4,8-naphthoquinone, 1-methylamino-5-n-butylamino-4,8-naphthoquinone, 1-methylamino-5-iso-propylamino-4,8-naphthoquinone, ethylamino-5-n-propylamino-4,8-naphthoquinone, 1-ethylamino-5-n-butylamino-4,8-naphthoquinone, 1-n-propylamino-5-n-butylamino-4,8-naphthoquinone. Sublimable dyes of the general formula (II) having a yellow color:

4-(2,2-dicyanovinyl)-N,N-dimethylaniline, 4-(2,2-dicyanovinyl-N,N-diethylaniline, 4-(2,2-dicyanovinyl)-N,N-di-n-propylaniline, 4-(2,2-dicyanovinyl)-N,N-di-isopropylaniline, 4-(2,2-dicyanovinyl)-N,N-di-n-butylaniline, 4-(2,2-dicyanovinyl)-N,N-di-iso-butylaniline, 4-(2,2-dicyanovinyl)-N,N-di-sec-butylaniline, 3-methyl-4-(2,2-dicyanovinyl)-N,N-dimethylaniline, 3-methyl-4-(2,2-dicyanovinyl)-N,N-diethylaniline, 3-methyl-4-(2,2-dicyanovinyl)-N,N-di-n-propylaniline, 3-methyl-4-(2,2-dicyanovinyl)-N,N-di-iso-propylaniline, 3-methyl-4-(2,2-dicyanovinyl)-N,N-di-n-butylaniline, 3-methyl-4-(2,2-dicyanovinyl)-N,N-di-iso-butylaniline, 3-methyl-4-(2,2-dicyanovinyl)-N,N-di-sec-butylaniline, 4-(2,2-dicyanovinyl)-N-ethyl-N-n-propylaniline, 4-(2,2-dicyanovinyl)-N-ethyl-N-n-butylaniline, 4-(2,2-dicyanovinyl)-N-methyl-N-n-propylaniline, 4-(2,2-dicyanovinyl)-N-methyl-N-n-butylaniline, 3-methyl-4-(2,2-dicyanovinyl)-N-methyl-N-n-propylaniline, 3-methyl-4-(2,2-dicyanovinyl)-N-methyl-N-n-butylaniline, 3-methyl-4-(2,2-dicyanovinyl)-N-ethyl-N-n-propylaniline, 3-methyl-4-(2,2-dicyanovinyl)-N-ethyl-N-n-butylaniline. Sublimable dyes of the general formula (III) having a magenta color:

4-tricyanovinyl-N,N-dimethylaniline, 4-tricyanovinyl-N,N-diethylaniline, 4-tricyanovinyl-N,N-di-n-propylaniline, 4-tricyanovinyl-N,N-di-iso-propylaniline, 4-tricyanovinyl-N,N-di-n-butylaniline, 4-tricyanovinyl-N,N-di-iso-butylaniline, 4-tricyanovinyl-N,N-di-secbutylaniline, 3-methyl-4-tricyanovinyl-N,N-dimethylaniline, 4-tricyanovinyl-N-methyl-N-n-propylaniline, 4-tricyanovinyl-N-methyl-N-n-butylaniline, 4-tricyanovinyl-N-ethyl-N-n-propylaniline, 4-tricyanovinyl-N-ethyl-N-n-butylaniline, 4-tricyanovinyl-N-ethyl-N-iso-butylaniline, 4-tricyanovinyl-N-ethyl-N-sec-butylaniline, 4-tricyanovinyl-N-n-propyl-N-n-butylaniline, 3-methyl-4-tricyanovinyl-N-methyl-N-ethylaniline.

As to a process for producing ink for forming the coloring material layer, the ink can be produced by mixing at least one dye of the above general formula (I), (II) or (III) with a resin having a high melting or softening point, one or more solvents such as water and the like, and non-sublimable particles.

The resin for preparing the aforesaid ink may be one which is used in conventional printing ink, and there can be used oil resins of, for example, rosin series, phenol series, xylene series, petroleum series, vinyl series, polyamide series, alkyd series, nitrocellulose series resins, alkyl cellulose series, ether series, ester series and the like; and aqueous resins such as maleic acid series resins, acrylic acid series resins, casein, shellac, glue and the like. More concretely, polycarbonates, polysulfones, polyphenylene oxides, cellulose derivatives and the like which have a high melting or softening point are particularly effective.

As solvent for preparing the ink, there can used alcohols such as methanol, ethanol, propanol, butanol and the like; cellosolves such as methyl Cellosolve, ethyl Cellosolve and the like; aromatic compounds such as benzene, toluene, xylene and the like; esters such as butyl acetate and the like; ketones such as acetone, methyl ethyl ketone, cyclohexanone and the like; hydrocarbons such as ligroin, cyclohexane, kerosine and the like; halogenated hydrocarbons such as dimethylformamide, methylene chloride, chlorobenzene, chloroform and the like; etc. When the aqueous resin is used, water or a mixture of water and one or more of the above-mentioned solvents can also be used.

Although the substrate used in this invention is not critical, a polymer film is particularly useful as the substrate. There can be used, for example, ester polymers such as polyethylene terephthalates (PET), polyethylene naphthalates, polycarbonates and the like; amide polymers such as nylon and the like; cellulose derivatives such as acetylcellulose, cellophane and the like; fluorine-contains polymers such as polyvinylidene fluoride, ethylene tetrafluoride-propylene hexafluoride copolymer, Teflon and the like; ether polymers such as polyoxymethylenes polyacetals and the like; olefin polymers such as polystyrenes, polyethylenes, polypropylenes, methylpentene polymers and the like; imide polymers such as polyimides, polyamideimides, polyetherimides and the like; etc.

In particular, when used in the substrate, the polyesters are useful because in this case, the substrate is thin, heat-resistant to some degree, and inexpensive. When used in the substrate, the imide, amide and the like polymers which are more heat-resistant than the polyesters are useful because in this case, the substrate is excellent in heat resistance even when the transfer sheet is used repeatedly or at a high speed.

Next, the action of the non-sublimable particles in the coloring material layer is explained below.

A transfer sheet for thermal printing 1 is, as shown in FIG. 1, composed of a substrate 2, a smooth heat-resistant layer 3 formed on one side of the substrate and a coloring material layer formed on the other side of the substrate. The coloring material layer is composed of a sublimable dye layer 4 containing, if necessary, a binder and non-sublimable particles 5 so that a part of the non-sublimable particles jut out from the refernece surface 1 of the sublimable dye.

The non-sublimable particles are very effective particularly when any point in the range 4*a* bounded by circles with a radius of 200 μm and with their centers at each point on the circumference of a section 5*a* of any non-sublimable particle 5 along the reference surface 1 of the sublimable dye is occupied by another non-sublimable particle. In this case, the non-sublimable particles are markedly effective particularly when the another non-sublimable particle is present anywhere in the region bounded by circles with a radius of 20 μm.

Further, the non-sublimable particles display a good effect when as shown in FIG. 1, the height of the non-sublimable particle 5 from the reference surface of the sublimable dye layer 4 ranges from 0.1 to 100 μm. They have a particularly excellent effect when said height is in the range $1\ \mu m \leqq h \leqq 10\ \mu m$. That is to say, a suitable particle size of the particle 5 is 0.1 to 100 μm, particularly 1 to 10 μm.

Figure 3:
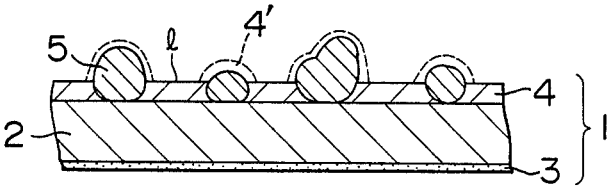
FIG. 3 and FIG. 4 are longitudinal sections of transfer sheets of other examples.

In this invention, the non-sublimable particles need not necessarily jut out from the sublimable dye layer, and as shown by the broken line in FIG. 3, the non-sublimable particles may be covered with a sublimable dye layer 4'. In this case, the reference surface l is as shown in FIG. 3. Even in this case, the action hereinafter described of the non-sublimable particles is not deteriorated at all.

Figure 4:
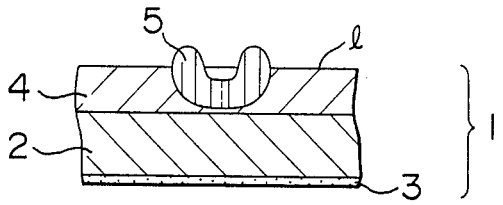

Such a non-sublimable particle as shown in FIG. 4 is regarded as two particles separated by the broken line in the figure. A non-sublimable particle having three or more projections is regarded in the same manner as described above. The action of the non-sublimable particles is retained not only when they are located on the substrate but also a part of them is buried in the substrate.

Figure 5:
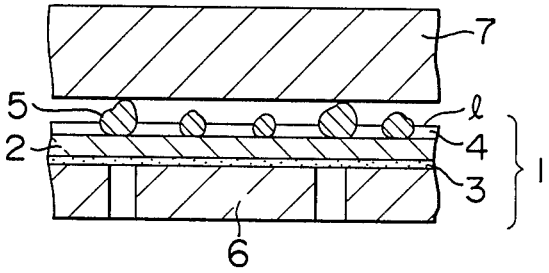
FIG. 5 is a longitudinal section of a printing portion.

Next, the action of the non-sublimable particles 5 is explained below with reference to the printing example shown in FIG. 5 in which a thermal head 6 is used. Since the sublimable dye layer 4 and the image-receiving sheet 7 do not come in direct contact with each other by virtue of the particle 5, no transfer of the dye by pressing or fusion occurs, and the dye is transferred only by sublimation or vaporization to give a good transparent image.

The binder has the following action. Since it holds a sufficient amount of the sublimable dye and reduces the distance between theh reference surface l and the image-receiving sheet, it gives a sufficient printing density to one image. Moreover, it enables the dye transfer sheet to withstand repeated use.

Figure 2:
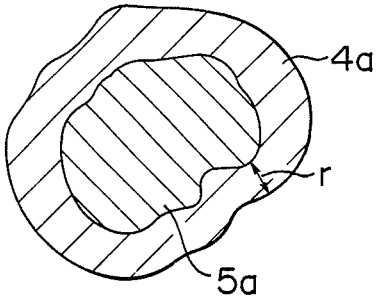
FIG. 2 is a partially sectioned plan of said transfer sheet.

The effects of the non-sublimable particles are not sufficient when no another non-sublimable particle is present in the range of $r=200\ \mu m$ or less shown by the exterior shadowed portion in FIG. 2, or when h in FIG. 1 is less than $0.1\ \mu m$. When h exceeds $100\ \mu m$, the sublimable dye is prevented from subliming, so that no image having a sufficient printing density can be obtained. Here, h is the maximum of the height of the non-sublimable particles measured from the reference surface l.

Needless to say, a density of the non-sublimable particles on the transfer sheet which is suitable for obtaining an image good in quality in the range of intermediate color tone depends on the size of picture element, the smoothness and homogeneity of the substrate, the image-receiving sheet and the like, etc. The larger the picture element is and the higher the smoothness and homogeneity of the substrate and the image-receiving sheets are, the non-sublimable particles fufill its function as a spacer at a lower density.

Figure 6:
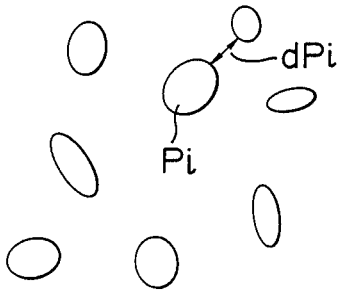
FIG. 6 illustrates the condition of arrangement of particles in a transfer sheet.
Figure 7:
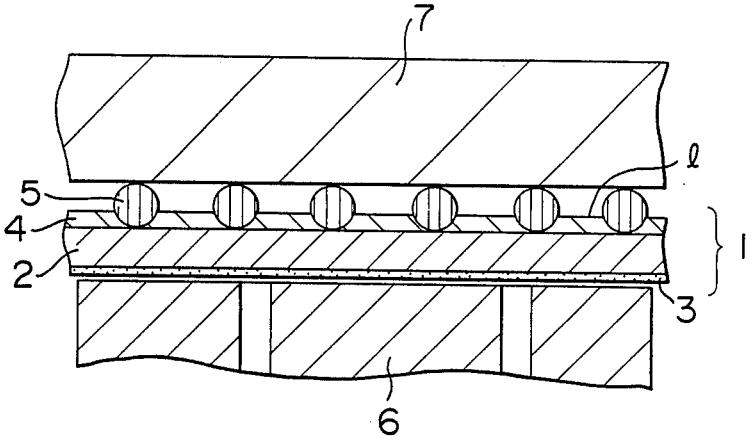
FIG. 7 is a longitudinal section of a printing portion in another example.

The density of the non-sublimable particles is reflected in the value of dpi described in the example in FIG. 6. As to the shape of the non-sublimable particles, spherical particles have particularly great effect. This is undoubtedly because each spherical particle has exactly the same spacer function in any location in relation to the transfer sheet. That is to say, as shown in FIG. 7, the distance between the substrate and the image-receiving sheet does not change at all with the change of the relative location described above. Among non-sublimable particles, particles of a metal, a metal oxide, a polymer composition or the like are particularly effective because of their high rigidity or elasticity.

The employment of a plurality of sublimable dyes also has a very characteristic effect. In order to obtain a black image by using sublimable dyes, a plurality of sublimable dyes are usually used. However, because of uneven transfer of the dyes, preferential transfer of the dye in the vicinity of the image-receiving sheet, and the like which are due to the direct contact of the dye layer with the image-receiving sheet, it has been very difficult to obtain a black image which is good over a wide range from a low printing density to a high printing density. However, in the case of a dye transfer sheet for thermal printing which is composed by using these sublimable dyes together with non-sublimable particles, transfer of each dye to the image receiving sheet by its uniform sublimation is facilitated, and there is no preferential transfer of the dye present in the vicinity of the image-receiving sheet, therefore each dye is uniformly transferred to the image-receiving sheet. Accordingly, there can be obtained a black image which is good over a wide range of printing density.

When at least one of a plurality of the dyes is selected from basic dyes (including colored dyes and color formers which develop color by means of an electron acceptor) and at least another one thereof is selected from disperse dyes, a black color having a very good tone and a high printing density can be obtained by properly selecting an acceptor. This seems to be because the basic dyes and disperse dyes are different in dye-site from each other and cause no interaction which is harmful to their dyeing and color production. Also by a combination of dyes of suitable kinds other than the above-mentioned combination, a good image having an optional hue can be obtained in a wide range of printing density.

Further, the non-sublimable particles have an excellent effect when the volume ratio thereof to the binder ranges $10^{-3}$ to $10^{2}$. At a lower ratio, the effect of the non-sublimable particles is not remarkable, while at a higher ratio, the particles are not sufficiently bound by the binder. In the above-mentioned range, a ratio of $10^{-2}$ to 10 is most effective.

For sufficient performance of the function as a spacer, the presence of at least three non-sublimable particles per transfer substrate corresponding to each picture element is necessary. If the non-sublimable particles are present at a density lower than this density, their function as a spacer is insufficient, so that noise occurs in the resulting image.

A material for the non-sublimable particles is selected from the group consisting of metals, metal oxides, metal sulfides, metal carbides, graphite, carbon black, silicon carbide, minerals, inorganic salts, organic pigments and polymer compositions. Examples of highly effective materials are enumerated below.

Metals: aluminun, silicon, germanium, tin, copper, zinc, silver, iron, cobalt, nickel, chromium, and alloys comprising these metals as their main constituent.

Metal oxides: alumina, beryllium oxide, magnesium oxide, copper suboxide, zinc oxide, indium oxide, tin oxide, titanium oxide, silicon oxide, iron oxide, cobalt oxide, nickel oxide, manganese oxide, tantalum oxide, vanadium oxide, tungsten oxide, molybdenum oxide and products obtained by doping these compounds with impurities.

Metal sulfides: copper sulfide, zinc sulfide, tin sulfide and molybdenum sulfide.

Minerals: soil minerals, lime minerals, strontium minerals, barium minerals, zirconium minerals, titanium minerals, tin minerals, phosphorum minerals, aluminum minerals (pagodite, kaolin and clay), silicon minerals (quartz, mica, talc, zeolite and diatomaceous earth).

Inorganic salts: carbonates or sulfates of alkaline earth metals (magnesium carbonate, calcium carbonate, strontium carbonate, barium carbonate, magnesium sulfate, calcium sulfate, strontium sulfate and barium sulfate) and inorganic salts comprising metal silicates as their main constituent.

Polymer compositions: phenol resins, melamine resins, urethane resins, epoxy resins, silicone resins, urea resins, diallyl phthalate resins, alkyd resins, acetal resins, acrylic resins, methacrylic resins, polyester resins, cellulose resins, starch and its derivatives, polyvinyl chlorides, polyvinylidene chlorides, chlorinated polyethylenes, fluorine-contained resins, polyethylenes, polypropylenes, polystyrenes, polydivinylbenzenes, polyvinyl acetals, polyamides, polyvinyl alcohols, polycarbonates, polysulfones, polyether sulfones, polyphenyleneoxides, polyphenylene-sulfides, polyether ether ketone, polyaminobismaleimides, polyarylates, polyethylene terephthalates, polybutyrene terephthalates, polyethylene naphthalates, polyimides, polyamide imides, polyacrylonitriles, AS resins, ABS resins, SBR and compositions comprising these polymers as their main constituent.

All of these materials have a high mechanical strength, are not fractured, for example, by a pressure bringing the transfer sheet into close contact with the image-receiving sheet, and hence are suitable for achieving the object of this invention. In addition to the polymer compositions described above, polymer compositions having a softening point of 100° C. or higher are particularly effective. This is because many of the usable dyes have a sufficient subliming ability even at a temperature lower than 100° C., and the polymer compositions satisfying the condition described above are not transferred to the image-receiving sheet; therefore a good transparent image printed with the dye alone.

A material for the polymer composition used in the smooth heat-resistant layer is not critical, and at the material, there can be used various curable resins (cross-linkable resins) which can be cured heat, light, electron beam or the like. In particular, the curable resins are good in adhesion to the substrate and heat resistance. They include, for example, silicone resins, acrylate resins, epoxy resins, unsaturated-aldehyde resins, etc. Cured products of the acrylate resins, in particular, have excellent characteristics. The resins curable by light or electron beam can easily be cured in a short time and hence permit easy production of a long transfer sheet, and they have good characteristics. For example, light- or electron beam-cured products of oligoacrylate or spiran resins, light-cured products of epoxy resins obtained by using an aromatic diazonium salt catalyst, etc. are excellent. The resins may be incorporated with various unreactive diluents at the time of use. The film thickness of the polymer composition is not critical. In general, a polymer composition having a film thickness of 0.1 μm or more from the surface for its production is easy to obtain and has uniform characteristic.

As the fine particles contained in the smooth heat-resistant layer, there can be used metals, metal oxides, metal sulfides, metal carbides, metal nitrides, metal fluorides, graphite, carbon black, minerals, inorganic salts, organic salts, organic pigments, etc. In particular, synthetic amorphous silica, carbon black, alumina, titanium oxide, molybdenum disulfide, boron nitride, graphite fluoride and the like are effective. The synthetic amorphous silica includes anhydrous silica and hydrated silica. As the anhydrous silica, ultrafine particles produced by a vapor phase process are useful. There are, for example, ultrafinely granulated silica of high purity developed by DEGUSA, West Germany (Aerosil, a trade name, manufactured by Nihon Aerosil Co., Ltd.), aluminum oxide and titanium oxide produced similarly by a vapor phase process (both manufactured by Nihon Aerosil Co., Ltd.), etc.

Depending on the characteristics of the dye to be used, the ultrafinely granulated silica reacts with the dye in some cases. Therefore, in such a case, there can be used hydrophobic silica obtained by chemically replacing a part of the silanol groups present in the silica by a methyl group. The ultrafine particles can sufficiently be dispersed by means of a supersonic wave, a triple roller, a homogenizer or the like.

White carbon comprises hydrated silicon dioxide as its main constituent and in some cases, contains calcium silicate. It is on the market by the name of, for example, "Carplex" of Shionogi & Co., Ltd., "Nipsil" of Nippon Silica Industrial Co., Ltd., and "Silton" of Mizusawa Industrial Chemicals, Ltd., or the like. The fine particles can be used in an amount in the range from 0.1 to 200% by weight based on the weight of the binder of polymer composition. In particular, the amount in the range from 5 to 100% by weight is preferable for the stability.

The liquid lubricating material includes, for example, dimethylpolysiloxane, methylphenylpolysiloxane, methylhydrodienepolysilone, fluorine-contained silicone oil, other various modified silicone oils (epoxy-modified, alkyl-modified, amino-modified, carboxyl-modified, alcohol-modified, polyether-modified, arkyl aralkyl.polyether-modified, epoxy.polyether-modified, and the like), silicone series lubricating material such as a copolymer of an organic compound, e.g., a polyoxyalkylene glycol and silicone, organic metal salts, various fluorine-contained surface active agents, fluorine-contained lubricating materials such as a low grade polymer of trifluoroethylene chloride and the like, alkylbenzenes, polybutenes, alkylnaphthalenes, alkyldiphenylethanes, phosphoric esters, synthetic oils such as polyalkylene glycol oils and the like, saturated hydrocarbons, animal and vegetable oils, minerals, etc.

Figure 8:
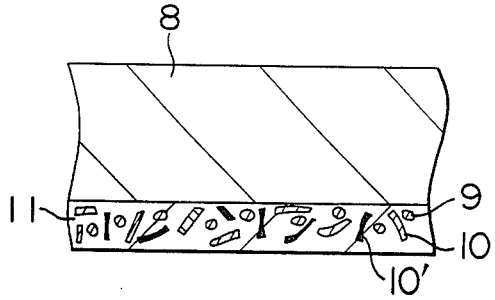
FIG. 8.
Figure 9:
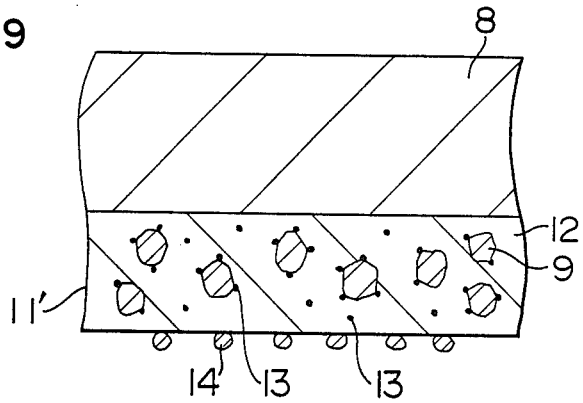
Figure 10:
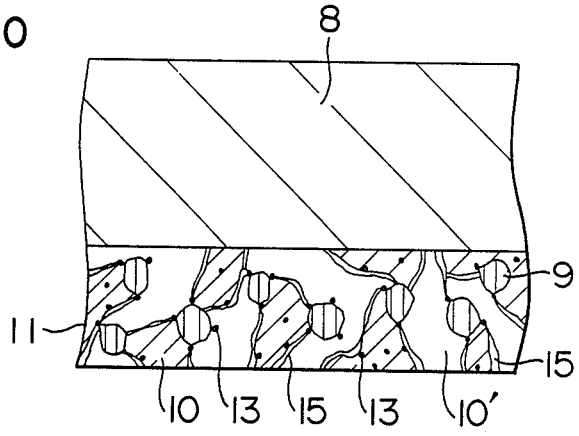

FIGS. 8 to 10 illustrate examples of the structure of the image-receiving sheet. Numeral 8 shows a substrate, which has, on its one side, a development layer 11 composed of inorganic fine particles 9 and two kinds of binders 10 and 10' which bind said fine particles and are immiscible with each other. Here, the binder 10 is assumed to have dye-affinity. Since two kinds of the mutually immiscible binders 10 and 10' constitute the main portion of the constitution of this invention, their action is explained below in detail. FIGS. 9 and 10 are cross-sectional views of two kinds of development layers 11' and 11, respectively, the former containing a single binder 12, and the latter containing two kinds of mutually immiscible binders 10 and 10'. When the single binder 12 is used as in FIG. 9, the coloration sites 13 for the dye are occupied by the binder 12, so that the dye molecules 14 sublimed from the dye layer of the transfer sheet by heat supplied from a thermal head are prevented from penetrating into the interior of the development layer 11'. On the other hand, in the case of FIG. 10, the dye molecules reach the coloration points 13 easily through micro spaces 15 formed in the development layer 11 to develop color because the binders 10 and 10' are immiscible with each other.

Here, as the binder 10, there are used polyesters, polyamides, acrylic resins, acetate resins, etc. which have the coloration sites 13 for the dye. As the binder 10' immiscible therewith, hydrocarbon resins, fluorine-contained resins, silicone resins and the like are effectively used. The hydrocarbon resins includes polyethylenes, polypropylenes, polystyrenes, polybutadienes, styrene-butadiene rubber (SBR), etc.

Considering that in general, these hydrocarbon resins, fluorine-contained resins and silicone resins have no coloration site for the dye, the effect of the binders of this invention due to their mutual immiscibility can be said to be very excellent. The hydrocarbon resins such as polyethylenes and the like are widely used and are particularly effective because they are inadhesive and have an effect of preventing fusion of the dye layer with the development layer by head of a thermal head.

Further, when a single binder is used, the dye molecules 14 which, as shown in FIG. 9, can not completely penetrate into the interior of the development layer 11' and accumulate on the surface, and do not come in contact with the coloration sites 13.

Therefore, they do not develop color sufficiently, are liable to be affected by the external environment, resulting in poorness of stability such as light resistance and the like, and are contaminated with extraneous foreign matters such as water, oil or the like, causing a marked lowering of the quality of image. Also in this respect, the employment of mutually immiscible binders in FIG. 10 is free from these adverse influences.

As the dye, disperse dyes, basic dyes and dye formers thereof are effectively used. Polyesters, polyamides, acrylic resins, acetate resins and the like give a stable and clear image by dispersing the dye molecules, and so do inorganic fine particles by adsorbing the dye molecules on their adsorption sites such as active sites, acidic sites and the like. As the inorganic fine particles, particles of silica, alumina, activated clay or the like having a particle size of 10 μm or less are effectively used. In particular, inorganic fine particles of silica, alumina or titanium oxide having an average particle size of 500 Å or less have a very high density of coloration sites per unit volume and contribute greatly to an increase of the printing density. Activated clay, silica and the like having acidity are also effective. Here, the volume ratio of the whole binder immiscible with the binder having dye-affinity to the whole of the latter binder is suitably in the range of 0.1 to 10, and at a ratio in this range, a large effect is obtained. At a ratio outside said range, the effect of the immiscibility is lost. The volume ratio of the inorganic fine particles to the total binders is suitably in the range of 0.1 to 10. When it is less than 0.1, no sufficient printing density is attained, while when it is more than 10, the binding effect of the binders is lessened. Therefore, both of such ratios are not desirable.

For further improving the light resistance and stability of an image printed with the dye, it is also effective to incorporate an ultraviolet ray absorbing agent and an antioxidant into the binders.

Figure 11:
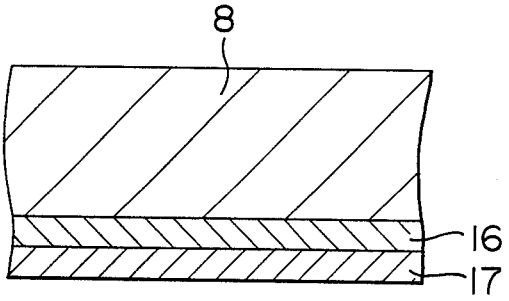
FIG. 9, FIG. 10 and FIG. 11 are cross-sectional views illustrating examples of the structure of an image-receiving sheet.

Another structure example of the image-receiving sheet is shown in FIG. 11. A second coloration layer 16 and a first coloration layer 17 are formed on a substrate 8. The first coloration layer makes the dyes develop color sufficiently, and has an effect of imparting stability to environments such as light, temperature, humidity and the like. The second coloration layer further diffuses the dyes present in the first coloration layer into the second coloration layer to provide a penetrated image, and has an effect of preventing bleeding phenomenon. By this combination of the first and second coloration layers, there can be obtained a penetrated image which has higher printing density and stability than when the first coloration layer alone is used.

Next, the effects of this invention are further explained below in more detail. The dye molecules sublimed according to the quantity of heat controlled by electric signals reach the surface of the first coloration layer, diffuse in the resin such as polyester or the like brought into a porous condition by the finely powdered oxide, and are adsorbed on the finely powdered oxide to cause coloration. In this case, the finely powdered oxide is more effective for the coloration when it is acidic. In this condition, the dye bleeds in the resin which is made porous in order to increase the concentration. Therefore, the dye is captured by forming the second coloration layer which is inferior in resistance to environment but superior in dye-adsorbing power to the first coloration layer, and diffusing the dye to the deep part of this coloration layer. Latexes of styrene-butadiene rubber (hereinafter abbreviated as SBR) and the like and finely powdered oxides such as activated clay, silica, calcium carbonate and the like can perform a function as the second coloration layer. The thickness of the first coloration layer is suitably 1 to 5 μm, and that of the second coloration layer 5 to 10 μm.

As the substrate for image-receiving sheet 8, homogeneous synthetic paper of polypropylene, polyester or the like having an almost uniform thickness gives a homogeneous image having only slight unevenness. As the synthetic paper, those produced by internal paper making method, (e.g., "Yupo" of Oji Yuka Synthetic Paper Co., Ltd.), those produced by a surface coating method (e.g., "Peachcoat" of Nisshin Spinning Co., Ltd.), substrates produced by laminating a polymer film on a paper substrate, etc. are effective for this invention.

EXAMPLE 1

A PET film of 9 μm in thickness was used as a substrate. A coating liquid having the composition shown in Table 1 was applied to the under surface of the film by means of a wire bar, and the solvent was evaporated by means of hot air, after which the residue was cured by irradiation with a 1 KW high pressure mercury arc lamp.

TABLE 1

| | Weight ratio |
|---|---|
| Epoxyacrylate resin (viscosity: 150 poises) | 12 |
| Neopentyl glycol diacrylate | 3 |
| 2-Hydroxy-2-methyl-propiophenone | 0.75 |
| White carbon (Carplex FPS-1) | 3.0 |
| Silicone oil | 0.15 |
| Surface active agent (L7500 mfd by Nippon Unicar Co., Ltd.) | 0.3 |
| Ethyl acetate | 100 |

Five parts each of the sublimable dyes represented by the following first, second and third formulae, 5 parts by weight of polycarbonate, 100 parts by weight of dichloromethane and various amounts of silica particles having an average particle size of 5 μm were stirred by using one ball mill for each amount of the silica particles. Each of the dispersions thus obtained was applied onto the aforesaid substrate for transfer sheet by means of a wire bar to obtain a three-color transfer sheet.

Here, the due of the first formula develops a cyan color, the dye of the second formula a magenta color, and the dye of the third formula a yellow color.

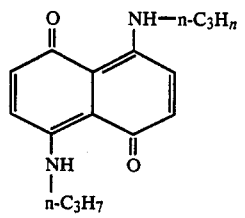

(1)

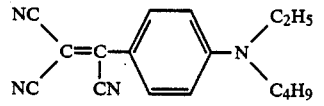

(2)

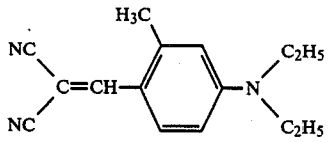

(3)

Three kinds of emulsions A, B and C prepared in the following manners were mixed in a suitable ratio and attached, as a development layer, to polypropylene synthetic paper to a thickness of 5 μm by means of a wire bar to obtain an image-receiving layer.

Coating liquid A: a 20% by volume aqueous dispersion of polyester (Vylon, a trade name).

B: a 20% by volume aqueous dispersion of polyethylene.

C: a 20% by volume aqueous dispersion of silica having an average particle size of 200 Å.

The coated portions of the transfer sheet and the image-receiving sheet were closely adhered together face to face with each other and allowed to produce a printed image with the dyes by using a thermal head. The printing conditions were as follows.

Line density of main scanning and sub scanning: 4 dots/mm

Printing electric power: 0.7 W/dot

Heating time of head: 8 ms

In Table 2 are shown the frequencies of dropout and noise in the images obtained under these conditions, and the maximum distance max (dpi) among the minimum distances dpi between projected figures of an arbitrary silica particle Pi and particles existing in the vicinity thereof. The relationship between the location of the particle Pi and the minimum distance dpi is shown in FIG. 6. The minimum distance dpi was determined from a scanning electron micrograph taken from the direction perpendicular to the condenser paper.

Further, h defined in FIG. 1 was determined from a scanning electron micrograph of a section of the dye transfer sheet to be 7 μm for all the various amounts of the silica particles incorporated. The results obtained in the case of incorporating no silica are also shown as a comparative example.

TABLE 2

| Amount of silica incorporated (part by volume) | Dropout (/1000 dots) | Noise (/100 dots) | Max (dpi) (μm) |
|---|---|---|---|
| $10^{-3}$ | 39 | 103 | 172 |
| $10^{-2}$ | 31 | 47 | 76 |
| $10^{-1}$ | 19 | 19 | 24 |
| 1 | 8 | 11 | 9 |
| 10 | 9 | 7 | 3 |
| $10^{2}$ | 23 | 7 | 2 |
| Comparative Example | 52 | 262 | — |

Figure 12:
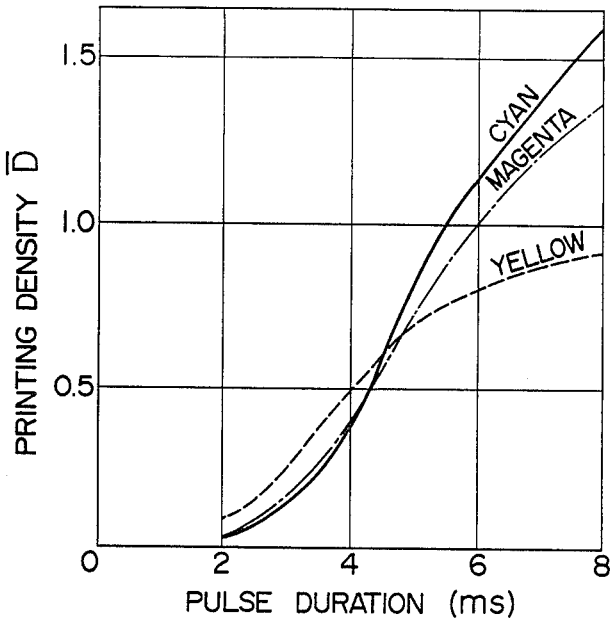
FIG. 12 and FIG. 13 are graphs for illustrating printing characteristics.
Figure 13:
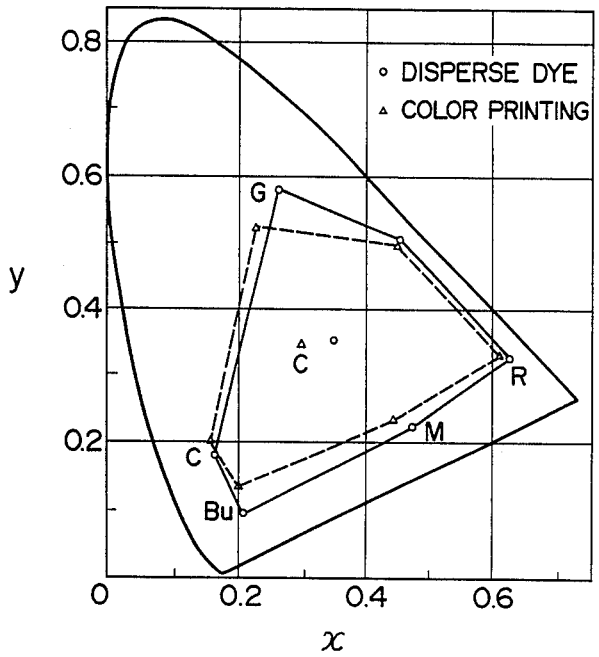

The printing densities were measured to be 1.6, 1.4, and 0.9 for cyan, magenta and yellow, respectively. The density characteristic in this case is shown in FIG. 12, and the color reproducibility is shown by a chromaticity diagram in FIG. 13.

Further, a sunlight resistance fastness test on the images produced with dyes was carried out according to the standard of JIS L 0841. In Table 3 are shown the volume ratio among the coating liquid A, B and C and the rating of sunlight resistance fastness of the colors, cyan, magenta and yellow.

TABLE 3

| Volume ratio among coating liquids | | | Fastness (rating) | | |
|---|---|---|---|---|---|
| A | B | C | Cyan | Magenta | Yellow |
| 9 | 1 | 10 | 3 | 3 | 3 |
| 7 | 3 | 10 | 4 | 4 | 4 |
| 5 | 5 | 10 | 4 | 4 | 5 |
| 3 | 7 | 10 | 4 | 3 | 4 |
| 1 | 9 | 10 | 3 | 3 | 4 |
| 7 | 3 | 50 | 4 | 3 | 4 |
| 5 | 5 | 50 | 3 | 3 | 4 |
| 3 | 7 | 50 | 3 | 3 | 3 |
| 7 | 3 | 2 | 4 | 4 | 5 |
| 5 | 5 | 2 | 4 | 4 | 5 |
| 3 | 7 | 2 | 4 | 3 | 4 |
| 10* | 0* | 10* | 2 | 2 | 3 |
| 0* | 10* | 10* | 2 | 1 | 2 |

*Comparative Example

EXAMPLE 2

For each of the sublimable dyes of a cyan, magenta or yellow color represented by the structural formulae (I), (II) and (III), ink was prepared by mixing 5 parts by volume of each dye, 5 parts by volume of polysulfone, 100 parts by volume of chlorobenzene and 20 parts by volume of alumina particles having an average particle size of 5 μm by means of a paint conditioner using glass beads for 30 minutes. The thus treated sublimable dyes of a cyan, magenta or yellow color were coated in sequence on the same substrate for transfer sheet as in Example 1 by means of a gravure printing machine (concave: 30 μm) to obtain a transfer sheet. By use of this transfer sheet, the three colors were printed one upon another on the same printing paper as described above by means of a thermal head under conditions similar to the above-mentioned printing conditions, whereby a full color image almost equal to photograph could be obtained.

EXAMPLE 3

By using dyes of the following formulae (1), (4) and (5) in amounts of 2 parts by volume, 2 parts by volume and 1 part by volume, respectively, in place of the dye of the first formula used in Example 1, preparation of ink, production of a transfer sheet, and transfer printing were carried out in the same manner as in Example 1 to obtain printing of a cyan color having a depth of color of 1.5.

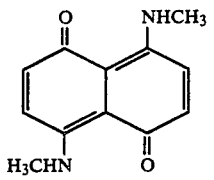

(5)

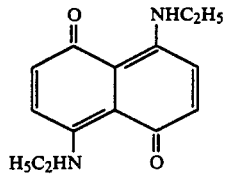

(4)

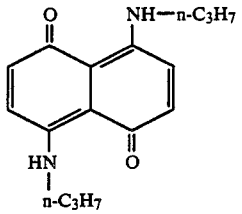

(1)

COMPARATIVE EXAMPLE

By using 5 parts by volume of the following dye (CI.Disperse.Blue 60):

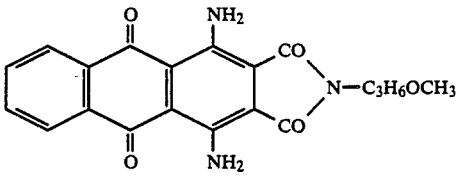

in place of the mixed dye used in Example 3, preparation of ink, production of a transfer sheet, and transfer printing were carried out. The depth of color of the cyan color obtained was 0.5 or less.

As described above, according to the dye transfer type thermal method for printing of this invention, there can be given stable running of transfer sheet and a printed image which is reduced in dropout and noise, has a good depth of color and a good quality of image, and is excellent in storage stability. Further, a full-color image also can be obtained by using three kinds of transfer sheets which develop a cyan color, a magenta color or a yellow color, respectively.

What is claimed is:

1. In a transfer sheet for thermal printing, the improvement wherein on a substrate is formed a coloring material layer containing at least one member selected from the group consisting of the sublimable dyes represented by the general formulae (I), (II) and (III):

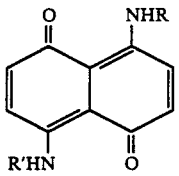

(I)

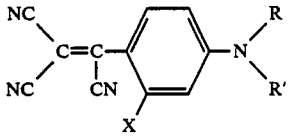

(II)

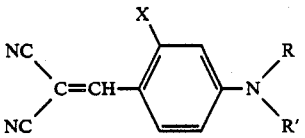

(III)

wherein X is a hydrogen atom or a methyl group and each of R and R' is a methyl group, an ethyl group, or a straight-chain or branched-chain propyl or butyl group.

2. A transfer sheet for thermal printing according to claim 1, wherein the aforesaid coloring material layer contains two or more sublimable dyes which are different in their substituents in the above general formulae.

3. A transfer sheet for thermal printing according to claim 1, wherein the aforesaid coloring material layer contains a binder.

4. A transfer sheet for thermal printing according to claim 3, wherein the aforesaid coloring material layer contains non-sublimable particles.

5. A transfer sheet for thermal printing according to claim 4, wherein a part of the non-sublimable particles jut out from the reference surface of the binder or the sublimable dye.

6. A transfer sheet for thermal printing according to claim 5, wherein the particle size of the non-sublimable particles ranges from 0.1 to 100 μm.

7. A transfer sheet for thermal printing according to claim 5, wherein the height of the non-sublimable particles from the aforesaid reference surface ranges from 0.1 to 100 μm.

8. A transfer sheet for thermal printing according to claim 5, wherein any point in the range bounded by circles with a radius of 200 μm and with their centers at each point on the circumference of a section of any non-sublimable particle along the reference surface.

9. A transfer sheet for thermal printing according to claim 4, wherein the sublimable dye is contained in the binder or in the surface or interior of the non-sublimable particles.

10. A transfer sheet for thermal printing according to claim 1, wherein a smooth heat-resistant layer composed of fine particles and a polymer is formed on the side reverse to one side of the aforesaid substrate on which the aforesaid coloring material layer is formed, and the surface of the aforesaid smooth heat-resistant layer is roughened by the aforesaid fine particles.

11. A transfer sheet for thermal printing according to claim 10, wherein the aforesaid smooth heat-resistant layer further contains a liquid lubricating material.

12. A transfer sheet for thermal printing according to claim 1, which has a polymer composition layer composed of a liquid lubricating material and a polymer on the side reverse to one side of the aforesaid substrate on which the aforesaid coloring material layer is formed.

13. A transfer sheet for thermal printing according to claim 1, wherein three coloring material layers different in hue which individually contain at least one sublimable dye selected from the group consisting of sublimable dyes of the general formulae (I), (II) and (III), respectively, are placed in sequence so as to join their surfaces together.

14. A transfer sheet for thermal printing according to claim 1, wherein three coloring material layers different in hue which individually contain at least one sublimable dye selected from the group consisting of sublimable dyes of the general formulae (I), (II) and (III), respectively, and the fourth coloring material layer containing sublimable dyes selected, at least one for each formula, from the groups consisting of sublimable dyes of the general formulae (I), (II) and (III) are placed in sequence so as to join their surfaces together.

15. A dye transfer type thermal method for printing which comprises placing a transfer sheet in which a coloring material layer containing at least one sublimable dye selected from the group consisting of sublimable dyes represented by the general formulae (I), (II) and (III):

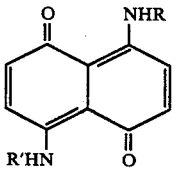

(I)

-continued

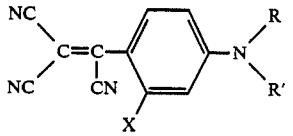

(II)

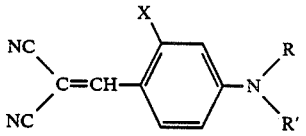

(III)

(wherein X is a halogen atom or a methyl group and each of R and R' is a methyl group, an ethyl group or a straight chain or branched chain propyl or butyl group), non-sublimable particles and a binder, a part of said non-sublimable particles jutting out from the reference surface of the sublimable dye layer, and an image receiving sheet having, on a substrate for image-receiving sheet, a development layer composed of inorganic fine particles, a binder having dye-affinity and another binder immiscible with said binder, so that the above-mentioned coloring material layer and development layer are placed face to face with each other; heating the resulting assembly selectively from the smooth heat-resistant layer side; and thereby forming an image on the image-receiving sheet.

16. A dye transfer type thermal method for printing according to claim 15, wherein there is used a transfer sheet in which three or more of the aforesaid non-sublimable particles are provided in any portion corresponding to a picture element.

* * * * *